United States Patent [19]

Morris

[11] 4,347,043

[45] Aug. 31, 1982

[54] MOTOR COMPRESSOR UNIT AND A METHOD OF DAMPENING SOUND WAVES GENERATED THEREIN

[75] Inventor: Richard D. Morris, Liverpool, N.Y.

[73] Assignee: Carrier Corporation, Syracuse, N.Y.

[21] Appl. No.: 155,871

[22] Filed: Jun. 2, 1980

[51] Int. Cl.[3] ..... F04B 39/00

[52] U.S. Cl. ..... 417/53; 181/202; 417/313; 417/902

[58] Field of Search ..... 417/53, 902, 312, 313, 417/363; 181/200, 202, 204, 256, 282

[56] References Cited

U.S. PATENT DOCUMENTS

| | | | |
|---|---|---|---|
| 1,584,485 | 5/1926 | Stille | 181/200 X |
| 2,808,122 | 10/1957 | Meyers | 181/204 |
| 3,273,670 | 9/1966 | Kleinlein | 188/1 B |
| 3,857,652 | 12/1974 | Thayer | 417/902 |

FOREIGN PATENT DOCUMENTS

| | | | |
|---|---|---|---|
| 523671 | 11/1953 | Belgium | 181/202 |
| 1026335 | 3/1958 | Fed. Rep. of Germany | 417/902 |
| 357147 | 9/1931 | United Kingdom | 181/202 |
| 971765 | 10/1964 | United Kingdom | 181/202 |

OTHER PUBLICATIONS

"Y-Line Two Pole Motor Compressors" by Copeland Corporation, Feb. 1974.

*Primary Examiner*—Carlton R. Croyle
*Assistant Examiner*—Edward Look
*Attorney, Agent, or Firm*—J. Raymond Curtin; John S. Sensny

[57] ABSTRACT

A motor compressor unit and a method of dampening sound waves generated therein. The motor compressor unit comprises a compressor for compressing a vapor, a motor for driving the compressor, a shell encompassing the compressor and motor, and a supply of lubricant disposed within the shell. The motor compressor unit further comprises a perforated lining positioned adjacent to the shell and annularly extending around the compressor for capturing a thin film or lubricant between the shell and the lining.

10 Claims, 3 Drawing Figures

MOTOR COMPRESSOR UNIT AND A METHOD OF DAMPENING SOUND WAVES GENERATED THEREIN

BACKGROUND OF THE INVENTION

This invention generally relates to motor compressor units, and more particularly to an arrangement for dampening sound waves generated therein.

Motor compressor units are widely used in refrigeration applications such as residential air conditioning. When used in such an application, a motor compressor unit is commonly located in or near one or more residential buildings. For example, the well known room air conditioner is usually mounted in a window or installed through a wall of the room which is cooled by the air conditioner. With other types of residential air conditionings systems, a motor compressor unit is positioned outside the conditioned room or building on a concrete slab or similar foundation, and often the motor compressor unit is near not only the conditioned room or building but also neighboring structures.

Many obvious advantages such as compactness and accessibility may result from locating the motor compressor unit in or near the conditioned space. However, disadvantages may also result. Specifically, motor compressor units of the type generally used in residential air conditioning systems have heretofore been a principal source of noise. When such a motor compressor unit is located in or near a building, the noise generated by the unit may exceed pre-defined levels of sound as established by certain municipalities.

SUMMARY OF THE INVENTION

In light of the above, an object of the present invention is to dampen sound waves generated within a motor compressor unit.

Another object of this invention is to alternately squeeze and expand selected areas of a thin, annular film of lubricant to reduce the noise transmitted by a motor compressor unit.

A further object of the present invention is to employ capillary action to facilitate capturing a thin, annular film of lubricant adjacent interior surfaces of a shell of a motor compressor unit and to transfer energy contained within sound waves generated in the motor compressor unit into lateral motion of the lubricant.

These and other objectives are attained with a motor compressor unit comprising compressor means for compressing a vapor, motor means for driving the compressor means, a shell encompassing the compressor and motor means, and a supply of lubricant disposed within the shell. The motor compressor unit further comprises a perforated lining positioned adjacent to the shell and annular extending around the compressor for capturing a thin, annular film of lubricant between the shell and the lining.

A BRIEF DESCRIPTION OF THE DRAWINGS

A DETAILED DESCRIPTION OF THE PREFERRED EMBODIMENT

Figure 1:
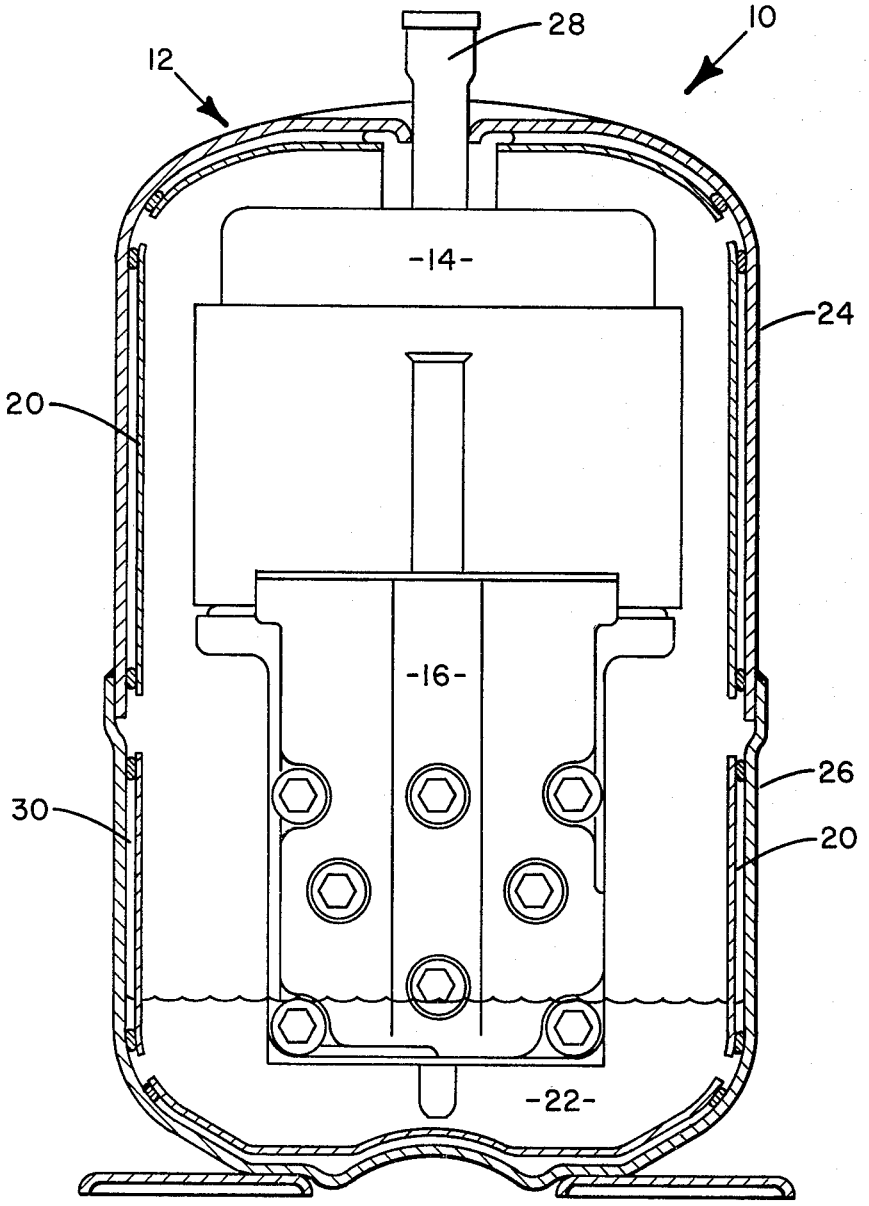
FIG. 1 is a side longitudinal view partly in cross section of a motor compressor unit illustrating teachings of the present invention.

Referring to FIG. 1, there is shown motor compressor unit 10 illustrating teachings of the present invention. Unit 10 includes casing or shell 12, electric motor 14, compressor 16, and perforated lining 20, with the motor, compressor, and lining all disposed within the shell. A supply of lubricant 22 such as oil is stored in a sump or reservoir defined by shell 12 and, during operation of unit 10, oil is drawn into compressor 16 to lubricate moving parts thereof. Preferably shell 12 includes top and bottom halves 24 and 26 which are welded together to hermetically seal unit 10. It should be made clear, however, that other types of motor compressor units, for example semi-hermetically sealed units, are well known in the art and may also be employed in the practice of the present invention.

Motor compressor unit 10 is well adapted for use in a refrigeration or air conditioning circuit. Low pressure refrigerant vapor enters unit 10 via inlet 28, flows over motor 14, cooling the motor, and then enters compressor 16. At the same time, motor 14 is employed to drive compressor 16, which compresses the vapor passing thereinto. After being compressed, the vapor is discharged from compressor 16 and unit 10 via an outlet line (not shown) and thence circulated through the rest of the refrigeration or air conditioning circuit. In the course of operation of motor compressor unit 10, the numerous moving parts thereof generate sound waves which, if transmitted to the surrounding ambient, may exceed predefined preferred noise levels. In view of this, motor compressor unit 10 is uniquely designed in accordance with the present invention to dampen sound waves generated therein.

Lining 20 plays a principal role in this sound dampening. Referring to lining 20 in greater detail, the lining is positioned adjacent shell 12 and annularly extends around at least compressor 16, since the compressor is the major source of noise in motor compressor unit 10. Preferably, lining 20 also annularly extends around motor 14, and most preferably the lining substantially encloses all of the motor and compressor 16, as depicted in FIG. 1. Further, regardless of the precise size of lining 20, preferably the lining extends downward into oil reservoir 22 for reasons discussed below.

Lining 20 is formed from relatively thin sheet metal having a stiffness which permits slight bending without deformation. As illustrated in FIG. 1, lining 20 and shell 12 may be spaced apart, defining space 30 therebetween, and the shell and lining may be secured together by any conventional means such as welding. Alternately, lining 20 may be press fitted into pressure contact with shell 12, with irregularities in adjacent surfaces of the lining and shell defining spaces therebetween. In either case, preferably, lining 20 is comprised of a plurality of separate sections to facilitate placing and securing the lining within shell 12.

Figure 2:
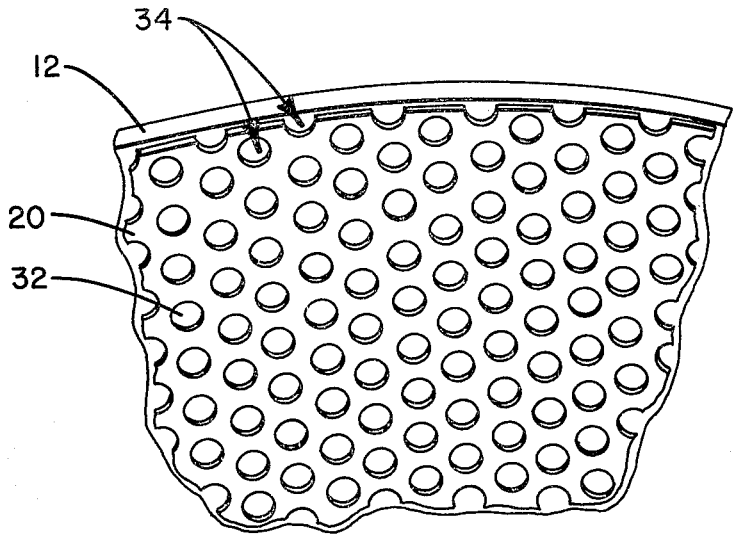
FIG. 2 is a front perspective view of sections of the shell and lining of the motor compressor unit shown in FIG. 1.
Figure 3:
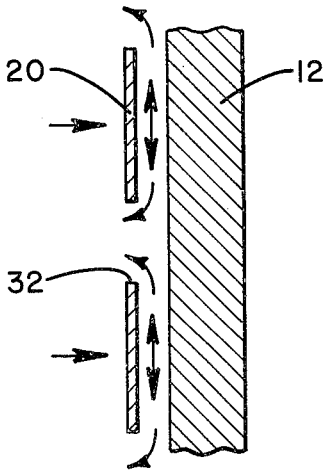
FIG. 3 is an enlarged side view of parts of the shell and lining of the motor compressor unit shown in FIG. 1.

Referring now to FIG. 2, lining 20 defines a plurality of perforations 32, which, as clearly shown in FIG. 3, extend through the lining. Preferably, perforations 32 include a multitude of substantially equally sized holes arranged in axially extending rows 34. The various rows 34 are equally spaced apart, and within each row, the holes thereof are also equally spaced apart. In addition, the axial position of holes 32 of any one row 34 are staggered relative to the axial position of the holes of adjacent rows, forming a zigzag pattern of holes around lining 20.

With the above-discussed arrangement, lining 20 captures a thin, annular film of oil between the lining and shell 12.

More particularly, oil passes into the space or spaces between shell 12 and lining 20 via one or both of two ways. First, as oil from reservoir 22 passes through compressor 16 to lubricate surfaces thereof, some of this oil becomes entrained with the refrigerant also passing through the compressor. This entrained oil flows with the refrigerant through the refrigeration or air conditioning circuit and reenters shell 12 via inlet 28. Some of this oil flows through the interior of shell 12 and is conducted outward through holes 32 and into the space or spaces between shell 12 and lining 20. Capillary attraction between this oil, shell 12 and lining 20 distributes the oil throughout the space or spaces between the shell and lining and tends to hold the oil in this area. It should be noted that, in case lining 20 is press fitted into pressure contact with shell 12, the annular film of oil captured between the shell and the lining may include gaps or discontinuities, since obviously oil will be absent from those surface areas of the shell and the lining which are in direct, abutting contact. With the preferred embodiment illustrated in the drawings, since lining 20 extends downward into oil supply 22, oil also passes into the space or spaces between the lining and shell 12 directly from the oil supply via capillary action.

With a thin, annular film of oil between lining 20 and shell 12, lining 20 transforms energy contained within sound waves generated in unit 10 into lateral motion of this oil. More specifically, sound waves generated within unit 10 travel outward and vary the pressure on the inside surface of lining 20. As perhaps best understood from FIG. 3, as the sound waves cause the pressure on the inside surface of lining 20 to exceed the pressure on the outside surface of the lining, this pressure differential pushes the lining outward toward shell 12, squeezing the oil film between the shell and solid surfaces of the lining. Since the oil is substantially incompressible, this squeezing action of lining 20 forces oil to move laterally between shell 12 and lining 20 and inward (away from shell 12) through holes 32. Thus, the oil film is squeezed at areas adjacent solid surfaces of lining 20 and expanded at areas adjacent holes 32. Preferably, the size and number of holes 32 are chosen so that the adhesive forces between the edges of lining 20 which defines holes 32 and the oil passing therethrough and the surface tension of this oil maintain the oil film substantially coherent as it expands through holes 32.

As the pressure on the inside surface of lining 20 decreases below the pressure on the outside surface thereof, this pressure difference plus the resiliency of the lining itself tend to return the lining to its original position. Hence, lining 20 moves away from shell 12, increasing the volume of space therebetween. The pressure difference between the inside and outside of lining 20, along with capillary attraction between oil and the lining and shell 12 draws oil, which had passed inward through holes 32, outward back through these holes and into the space between lining 20 and shell 12. Thus, the previously expanded areas of the oil film are contracted and the previously squeezed areas of the oil film are expanded. As sound waves continue to be generated within unit 10, this compression-expansion action of the oil film and lining 20 also continues, effectively muting the sound waves.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

I claim:

1. A motor compressor unit comprising:

a shell;

compressor means located within the shell for compressing a vapor;

motor means located within the shell for driving the compressor means;

a supply of lubricant disposed within the shell; and a resilient lining positioned adjacent to the shell, annularly extending around the compressor means, and defining a plurality of perforations extending through the lining to conduct lubricant entrained in vapor within the shell through the lining and between the shell and the lining to capture a thin, annular film of lubricant therebetween.

2. A motor compressor unit as defined by claim 1 wherein the lining defines a multitude of substantially equally sized circular openings.

3. A motor compressor unit as defined by claim 2 wherein the lining extends into the lubricant supply to facilitate movement of lubricant upward therefrom between the lining and the shell by capillary action.

4. A motor compressor unit as defined by claim 3 wherein:

the lining is spaced from the shell; and further including means securing the lining to the shell.

5. A motor compressor unit as defined by claim 3 wherein the lining is in pressure contact with the shell.

6. A method for dampening sound waves generated within a motor compressor unit having a shell, a supply of lubricant disposed therewithin, compressor means located within the shell, and a lining extending around the compressor means, positioned adjacent to the shell, and defining a plurality of perforations extending through the lining, the method comprising the steps of:

conducting lubricant through the lining perforations and between the shell and the lining to capture a thin, annular film of lubricant extending around the compressor means; and transforming energy contained within the generated sound waves into lateral motion of the lubricant.

7. A method as defined by claim 6 further including the step of using capillary action to move lubricant from a supply thereof upward between the lining and the shell.

8. A method as defined by claims 6 or 7 wherein the transforming step includes the steps of:

squeezing the lubricant film at a plurality of first areas; and expanding the lubricant film at a plurality of spaced, second areas.

9. A method as defined by claim 8 wherein the transforming step further includes the step of subsequently expanding the lubricant film at the first areas to contract the lubricant film at the second areas.

10. A method as defined by claim 8 wherein:

the conducting step includes the step of conducting lubricant outward through the lining perforations; and the expanding step includes the step of forcing lubricant inward through the perforations.

* * * * *